US008132512B2

(12) United States Patent
Helmick

(10) Patent No.: US 8,132,512 B2
(45) Date of Patent: Mar. 13, 2012

(54) RAILROAD TIE PLATE APPARATUS AND METHOD

(75) Inventor: Stoney L. Helmick, Cox's Mills, WV (US)

(73) Assignee: H & H Railroad Contracting, Inc., Glenville, WV (US)

( * ) Notice: Subject to any disclaimer, the term of this patent is extended or adjusted under 35 U.S.C. 154(b) by 257 days.

(21) Appl. No.: 12/416,565

(22) Filed: Apr. 1, 2009

(65) Prior Publication Data

US 2010/0224096 A1 Sep. 9, 2010

Related U.S. Application Data

(60) Provisional application No. 61/157,364, filed on Mar. 4, 2009.

(51) Int. Cl.
*E01B 3/00* (2006.01)

(52) U.S. Cl. ..... 104/16; 104/2

(58) Field of Classification Search ..... 104/2, 16
See application file for complete search history.

(56) References Cited

U.S. PATENT DOCUMENTS

| | | | | | |
|---|---|---|---|---|---|
| 3,157,267 | A * | 11/1964 | Asbury | 198/310 |
| 4,168,771 | A | 9/1979 | Krivec | |
| 4,211,170 | A * | 7/1980 | Theurer | 104/2 |
| 4,225,429 | A * | 9/1980 | Holley | 209/215 |
| 4,280,613 | A | 7/1981 | Stewart | |
| 4,576,538 | A * | 3/1986 | Theurer et al. | 414/339 |
| 4,691,639 | A * | 9/1987 | Holley | 104/16 |
| 4,733,614 | A | 3/1988 | Mohr et al. | |
| 4,770,103 | A | 9/1988 | Allmer | |
| 4,942,822 | A | 7/1990 | Cotic | |
| 5,067,412 | A | 11/1991 | Theurer et al. | |
| 5,090,484 | A * | 2/1992 | Theurer et al. | 171/16 |
| 5,109,775 | A * | 5/1992 | Kershaw et al. | 104/2 |
| 5,193,461 | A | 3/1993 | Theurer et al. | |
| 5,305,692 | A | 4/1994 | Madison et al. | |
| 5,331,899 | A | 7/1994 | Holley | |
| 5,419,259 | A | 5/1995 | Theurer et al. | |
| 5,722,325 | A | 3/1998 | Glomski et al. | |
| 5,839,377 | A | 11/1998 | Brenny et al. | |
| 6,170,401 | B1 | 1/2001 | Miller et al. | |
| 6,595,140 | B1 | 7/2003 | Madison et al. | |
| 6,807,909 | B1 * | 10/2004 | Coots | 104/16 |
| 7,827,916 | B2 * | 11/2010 | Coots, Jr. | 104/16 |
| 2004/0003748 | A1 * | 1/2004 | Theurer et al. | 104/2 |
| 2006/0045684 | A1 * | 3/2006 | Sperling | 414/434 |
| 2009/0095188 | A1 * | 4/2009 | Bounds | 104/2 |
| 2009/0133598 | A1 * | 5/2009 | Coots, Jr. | 104/2 |
| 2010/0132582 | A1 * | 6/2010 | Theurer et al. | 104/2 |
| 2010/0224096 | A1 * | 9/2010 | Helmick | 104/2 |

* cited by examiner

*Primary Examiner* — S. Joseph Morano
*Assistant Examiner* — Jason C Smith
(74) *Attorney, Agent, or Firm* — Steptoe & Johnson PLLC

(57) ABSTRACT

First and second conveyors are positioned along opposite sides of a frame positioned about centrally between the first and second conveyors, wherein the first and second conveyors are operably connected to a railroad engagement wheel positioned under the frame to coordinate movement of the first and second conveyors relative to the railroad engagement wheel. The conveyors can be integrated with a hi-rail truck adapted for use with the first and second conveyors and which contains an infeed conveyor for transporting tie plates from the hi-rail truck to the first and second conveyors.

19 Claims, 6 Drawing Sheets

RAILROAD TIE PLATE APPARATUS AND METHOD

CROSS REFERENCE TO RELATED APPLICATIONS

This application claims the benefit of U.S. patent application No. 61/157,364 which was filed Mar. 4, 2009.

FIELD OF INVENTION

The present application relates to railroad tracks, and more particularly to an apparatus and method for distributing railroad tie plates adjacent to the rails of railroad tracks.

BACKGROUND

The rails of a railroad track are usually secured to cross ties by spikes driven into tie plates, with the tie plates located between the rail and the tie, and the head of the spike overlapping the bottom of the rail. The tie plates block lateral movement of the rails. Anchors are attached to the rail on either side of the tie to secure the rail against longitudinal movement.

Railroad ties occasionally must be replaced due to wear. After a tie is replaced, tie plates must be provided between the rail and the tie so that the rail may be properly secured to the tie.

Several references propose various systems for use in replacing tie plates. For example, U.S. Pat. No. 4,280,613, issued to J. K. Stewart on Jul. 28, 1981, describes a tie plate conveying and orienting system.

U.S. Pat. No. 4,770,103, issued to F. Allmer on Sep. 13, 1988, describes a rail clamp. The rail clamp includes a pair of line-up wheels for engaging the inside edges of the rails. A pair of pivoting clamping arms, with each clamping arm having a disk rotatably mounted to its end, engages the outside edge of each rail, just below the rail's ball. Movement of the clamping arms is controlled by hydraulic cylinders. Additionally, a stabilizer cylinder connecting a bridge crossing the chassis to the rail lifting assembly may either permit the rail lifting assembly to float to correspond with the rails, or may be locked in position.

U.S. Pat. No. 4,733,614, issued to G. Mohr et al. on Mar. 29, 1988, describes a machine for repairing a railway track. The machine includes a main chassis having various devices for repairing a railway, mounted on a chain drive under a railway vehicle. A counter weight mounted to the chain drive, moving the opposite direction, counters the effects of inertia.

U.S. Pat. No. 4,942,822, issued to D. J. Cotic on Jul. 24, 1990, describes an apparatus and method for automatically setting rail tie plates. The apparatus includes a frame having a ramp thereon. The ramp stores the tie plates, and includes a control mechanism for releasing them one at a time into a plate pocket. A reciprocated pusher then moves the plate from the plate pocket to its position on the tie.

U.S. Pat. No. 5,067,412, issued to J. Theurer et al. on Nov. 26, 1991, describes a tie plate-inserting machine. The front of the machine includes a crane broom with a tie plate-collecting magnet. A funnel adjacent to the crane leads to a conveyer, which terminates above a sorting table. A roller conveyer conveys ties from the sorter to a magazine. The magazine moves between a level position for receiving tie plates from the sorting table, and a lower position for dispensing the tie. The machine includes a tie plate-inserting arm slidably supported by a guide rod, for pushing the-tie plates from the magazine to their position below the rail. A lifting roller pivots between a raised position and a lowered position for permitting tie plates to be pushed thereon from the magazine to their final position below the rail.

U.S. Pat. No. 5,193,461, issued to J. Theurer et al. on Mar. 16, 1993, describes a tie exchange mean for both removing ties and inserting new ties. The tie exchange machine may move longitudinally along a guide track. A scarifier and track-lifting device are included. A mobile tie transporting crane may move towards or away from the tie exchange device, for transporting either new ties to be installed or old ties which have been removed. The tie-depositing device is a vertically adjustable forklift.

U.S. Pat. No. 5,305,692, issued to H. Madison et al. on Apr. 26, 1994, and assigned to Harsco Corporation, describes a tie exchanger mounted on a truck. The tie exchanger has a rail clamp table having rail clamps and a boom. The boom includes a tie clamp, and may pivot around the vertical axis to insert ties from either side of the tracks.

U.S. Pat. No. 5,331,899, issued to J. D. Holley on Jul. 26, 1994, describes a tie plate installer and remover using a magnetic wheel to insert or remove a tie plate. The tie plate installer includes a tie magazine from which tie plates are dropped into a shoot leading to the magnetic wheel, which then carries the tie plate to a position on the tie adjacent to its final location under the rail, and finally pushes it under the rail.

U.S. Pat. No. 5,419,259, issued to J. Theurer et al. on May 30, 1995, describes a ballast stabilizer. The ballast stabilizer has a rail clamp including a roller for engaging the rail's ball, mounted on an arm secured at its other end to a lever. The opposite arm of the lever is secured to a hydraulic cylinder, so that extending the cylinder pushes inward on the clamp arm. A pair of vertical inner wheels are pushed against the gauge side of the rail's ball by hydraulic cylinders. A shaking apparatus vibrates the machine parallel to the ties.

U.S. Pat. No. 5,722,325, issued to K. E. Glomski et al. on Mar. 3, 1998, describes a tie replacement apparatus including drip elements for holding a tie plate in place while the tie underneath is replaced.

U.S. Pat. No. 5,839,377, issued to D. M. Brenny et al. on Nov. 24, 1998, describes a machine for installing and removing elastic rail clips of the type used for fastening rails to concrete or wooden ties.

U.S. Pat. No. 6,170,401, issued to R. Miller et al. on Jan. 9, 2001, describes a rail vehicle for collection and distribution of railroad cross ties.

When replacing tie plates, it is useful to position the tie plates near the section of track where the plates will be used to secure the rail to the ties. More specifically, it would be helpful to be able to automatically or semi-automatically place a tie plate at the respective ends of a railroad tie to which a section of rail is going to be attached. Furthermore, it is desirable to be able to easily manipulate and move an apparatus which could automate the tie-placement system and to tie such an apparatus into an existing hi-rail truck or other rail-vehicle system. Accordingly, a railway tie placement apparatus and method incorporating these features is desired.

SUMMARY

The present application teaches an apparatus and method for depositing railroad tie plates adjacent both rails of a set of railroad tracks simultaneously or nearly simultaneously. The application teaches parallel cleated belt conveyors timed relative to the rate of rotation of one or more railroad engagement wheels under a frame between the conveyors to ensure proper spacing between the tie plates along the length of rail. Sliding members positioned above the upper end of the conveyors help transfer the tie plates from an optional infeed conveyor to the cleated belt conveyors.

BRIEF DESCRIPTION OF THE DRAWINGS

The present invention is described with reference to the accompanying drawings.

DESCRIPTION OF THE PREFERRED EMBODIMENT

Figure 1:
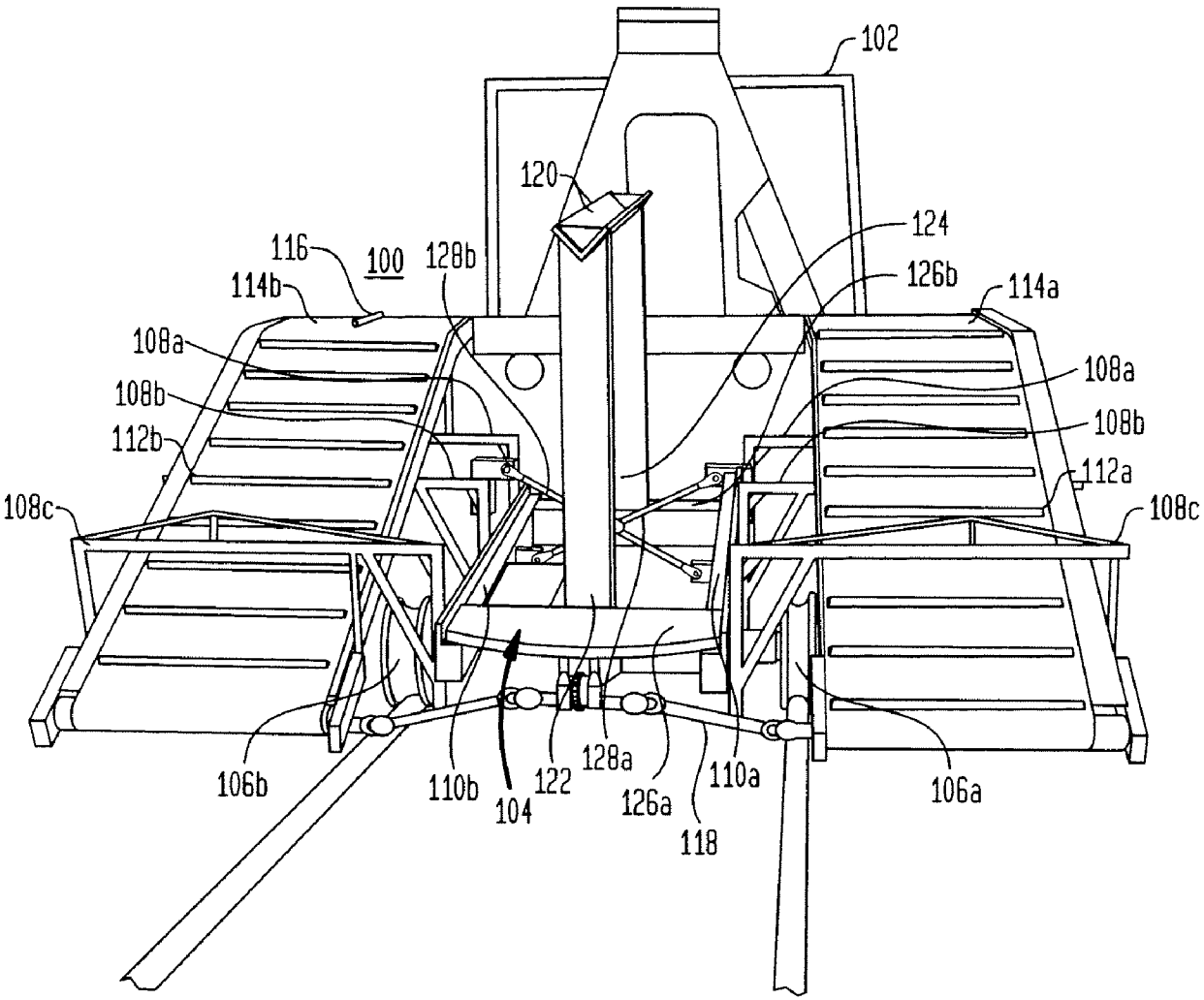
FIG. 1 is a rear view showing most clearly the frame, lifting member, and conveyors in relation to a set of railroad tracks and a hi-rail truck.

According to the present application, an apparatus is described which provides an automatic or semi-automatic conveyor belt system for placing railroad tie plates adjacent the parallel rails of a length of railroad track.

According to one aspect of the invention, the apparatus includes a generally rectangular frame having at least two rail engagement wheels positioned under the frame; two or more connecting members attached to each of the long sides of the frame; two cleated belt conveyors, one attached to each of the long sides of the frame by the connecting members; a towing member extending away from an end of the frame; a sliding member positioned above each of the cleated belt conveyors and having a tie plate guiding member adjustably connected to the sliding member; a drive member connected to and extending between at least one of the railroad engagement wheels and the cleated belt conveyors for controlling the speed at which the cleated belt conveyors operate; and a lifting member extending vertically from the frame, wherein the lifting member has a generally inverted U-shape and a first end of the lifting member is connected at about a mid-point of a first short side of the frame and a second end of the lifting member is connected at about a mid-point of a second short side of the frame.

Another aspect of the invention is an apparatus having first and second conveyors positioned along opposite sides of a frame positioned about centrally between the first and second conveyors; wherein the first and second conveyors are operably connected to a railroad engagement wheel positioned under the frame to coordinate movement of the first and second conveyors relative to the railroad engagement wheel.

Another aspect of the invention is a method of placing railroad tie plates alongside a rail by alternately feeding railroad tie plates to first and second sliding members, wherein a first sliding member is positioned above a first conveyor belt and a second sliding member is positioned above a second conveyor belt, further wherein the first and second conveyors are positioned along opposite sides of a frame positioned about centrally between the first and second conveyors and the first and second conveyors are operably connected to a railroad engagement wheel positioned under the frame to coordinate movement of the first and second conveyors relative to the railroad engagement wheel; and sliding the railroad tie plates along the sliding member and onto one of the conveyor belts.

One specific application of this apparatus and system involves integration with a hi-rail truck or other similar rail vehicle adapted to feed railroad tie plates to the apparatus for automatic or semi-automatic placement of the tie plates alongside a length of railroad track and more specifically outside the respective parallel rails of the track and adjacent the ends of the railroad ties. The hi-rail truck can include an infeed conveyor for transporting the tie-plates from the bed of the truck to the cleated belt conveyors.

The preferred embodiment will be described with reference to FIG. 1, which shows an exemplary apparatus 100 of the present invention integrated with a hi-rail truck 102. The apparatus 100 comprises a generally rectangular frame 104 having at least two rail engagement wheels 106*a*, 106*b* positioned under the frame 104. Two or more connecting members 108*a-c* are attached to each of the long sides 110*a*, 110*b* of the frame 104. Two cleated belt conveyors 112*a*, 112*b* are attached to the long sides 110*a*, 110*b* of the frame 104 by the connecting members 108*a-c*. A towing member 202 extends away from an end 204 of the frame 104. A sliding member 114*a*, 114*b* is positioned above each of the cleated belt conveyors 112*a*, 112*b* and having a tie plate guiding member 116 adjustably connected to the sliding member 114*a* or 114*b*. A drive member 118 can be connected to and extend between at least one of the railroad engagement wheels 106*a* or 106*b* and the cleated belt conveyors 112*a*, 112*b* for controlling the speed at which the cleated belt conveyors 112*a*, 112*b* operate. A lifting member 120 can extend vertically from the frame 104, wherein the lifting member 120 has a generally inverted U-shape and a first end 122 of the lifting member 120 is connected at about a mid-point of a first short side 126*a* of the frame 104 and a second end 124 of the lifting member 120 is connected at about a mid-point of a second short side 126*b* of the frame 104. Conveyor belt 112*a,b* raising and lowering means 128*a*, 128*b* can be included to raise and lower the cleated belt conveyors 112*a*, 112*b*.

Figure 2:
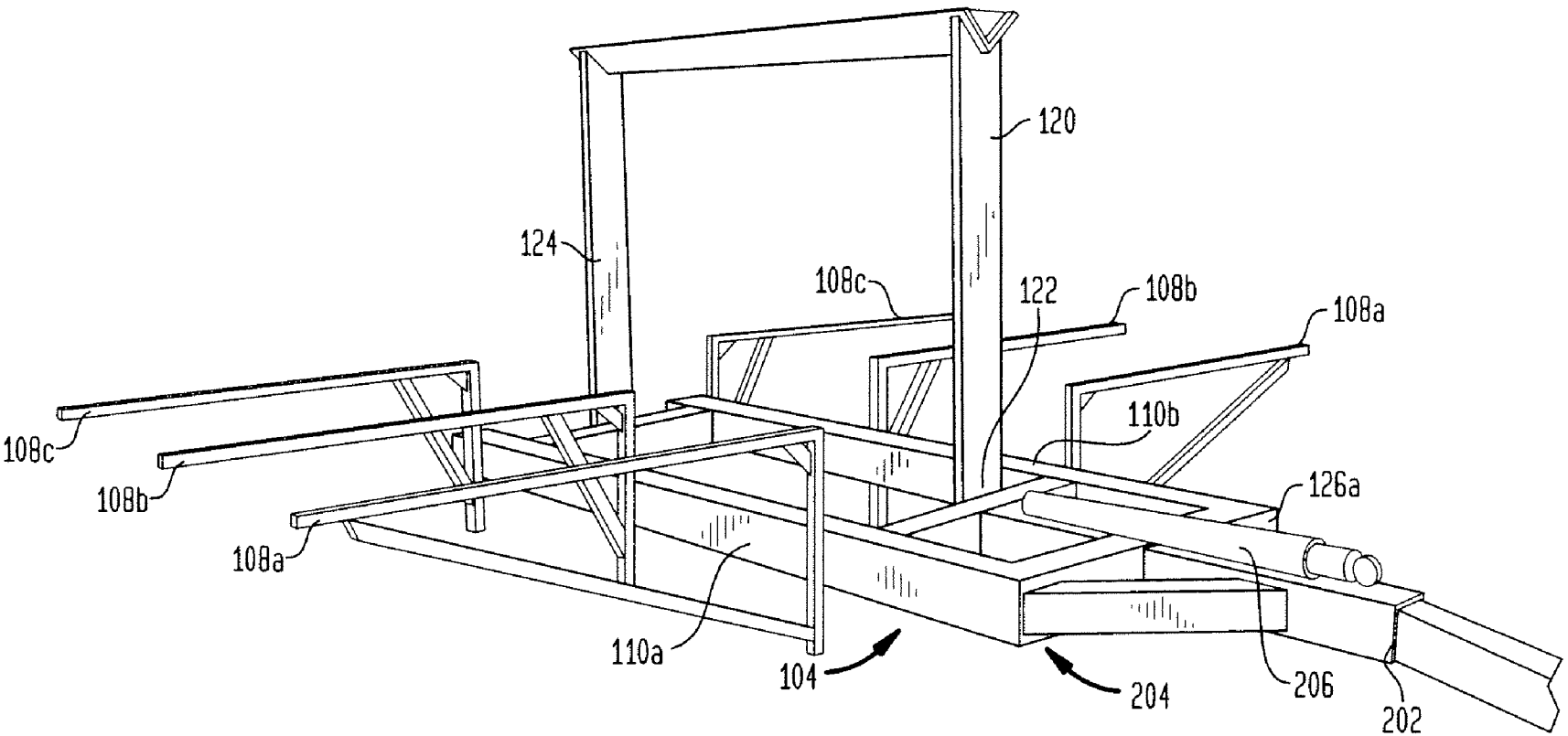
FIG. 2 shows the frame, lifting member, and connecting members without the conveyor belts.

As shown more clearly in FIG. 2, the frame 104 is generally rectangular in shape with two long sides 110*a*, 110*b* and two short sides 126*a*, 126*b*. A lifting member 120 is in the shape of an inverted U with a first end 122 of the lifting member 120 connected at about a mid-point of a first short side 126*a* of the frame 104 and a second end 124 of the lifting member 120 connected at about a mid-point of a second short side 126*b* of the frame 104. The apparatus 100 preferably includes three connecting members 108*a-c* connected to each of the long sides 110*a,b* of the frame 104. The connecting members 108*a-c* can be triangular-shaped with a short side of the triangles connected to the outside edge of the long sides 110*a,b* of the frame 104. A towing member 202 extends from one of the short sides 126*a* or 126*b* of the frame 104. The towing member 202 preferably is extendable and includes a means for extending and retracting the towing member. A preferred extending and retracting means is a cylinder 206 for extending and retracting the towing member 202, which can be used to connect the frame 104 of the apparatus 100 to a hi-rail truck 102 or other vehicle for transporting the apparatus 100 along a railroad track.

Figure 3:
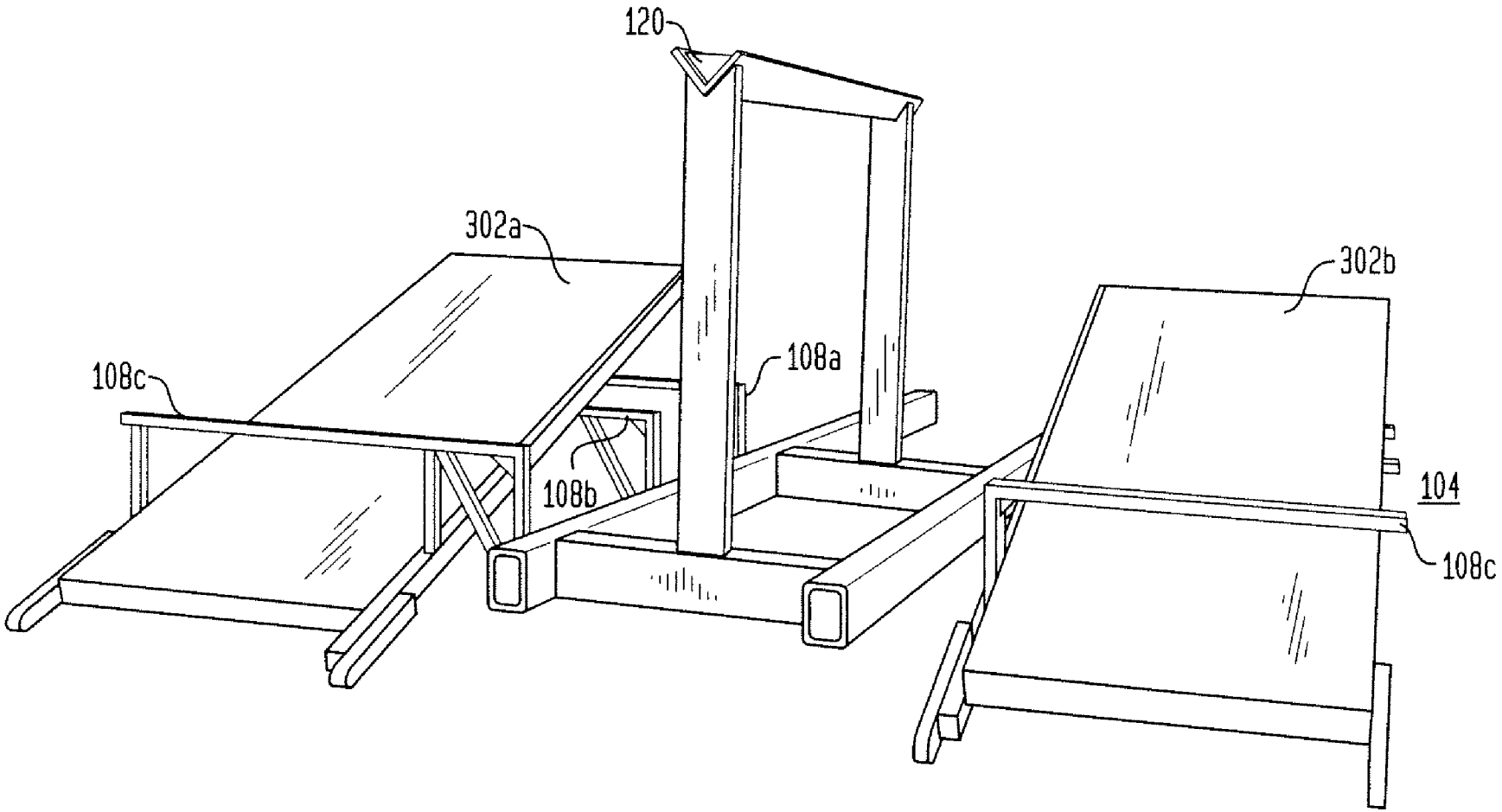
FIG. 3 shows the conveyor belts being placed on the connecting members of the apparatus from FIG. 2.

FIG. 3 shows the frame 104 of FIG. 2 with conveyor belt support members 302*a* and 302*b* attached to the connecting members 108*a-c*. The connecting members 108*b* can extend through a first side of a conveyor belt support member 302*a,b* and cross underneath the width of the conveyor belt support members 302*a,b* and be secured to a second side of the conveyor belt support member 302*a,b*. The connecting member 108*a* and 108*c* include additional bracketry for connecting the connecting members 108*a* and 108*c* to the conveyor belt support members 302*a,b*.

Figure 4:
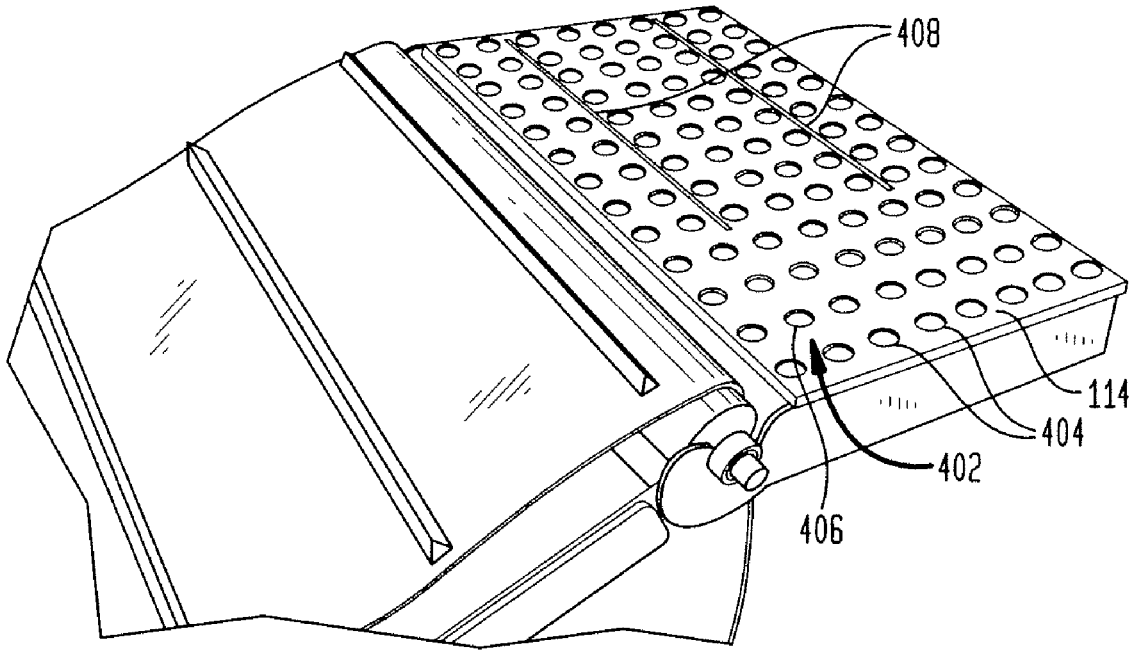
FIG. 4 shows a close-up view of a sliding member at the top of a conveyor belt.

FIG. 4 shows a sliding member 114 positioned above a cleated belt conveyor 112. The sliding member 112 has a top surface 402 and includes a plurality of ball bearings 404 embedded in the sliding member 112 and projecting above the top surface 402 of the sliding member 112. Each ball bearing 404 is contained within an opening 406 in the top surface 402 of the sliding member 112, but the ball bearings 404 rotate freely within the openings 406 thereby creating a surface over which the tie plates can be slid with little manual effort. The sliding member 114 includes two guide troughs 408 for receiving a tie plate guiding member 116. The position of the tie plate guiding member 116 on the sliding member 114 can be adjusted by moving the sliding member 114 along the guide troughs 408 and securing the guiding member 116 in place by inserting a screw through the guiding member 116 and the guide troughs 408 and locking it in place with a nut.

Figure 5:
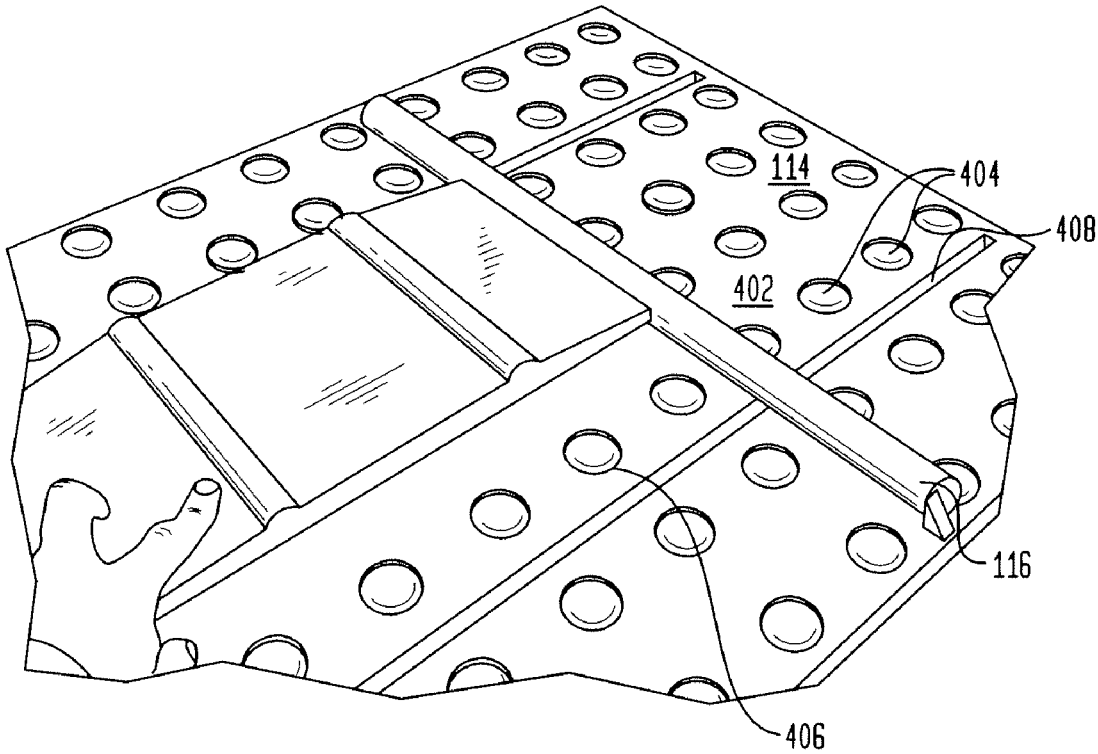
FIG. 5 shows a close up of a guiding member adjustably positioned on the top surface of a sliding member.

As shown in FIG. 5, the position of the guiding member 116 on the sliding member 114 can be adjusted to accommodate different size tie plates and also can be adjusted depending on the desired placement of the tie plate on the conveyor belt 112. For example, the width of conveyor belt 112 can be about two times the width of the tie plates and thus the tie plates can be positioned on the inside or outside half of the conveyor belt 112. As a result, the tie plates can be dropped either closer to or further away from the railroad track rails depending on the placement of the tie plates on the conveyor belts 112. The tie plates can be slid across the sliding member 114 up to and against the guiding member 116 which stops the lateral movement of the tie plates. The tie plates can then be re-directed perpendicularly by sliding the tie plates on the sliding member 114 towards the conveyor belts 112.

Figure 6:
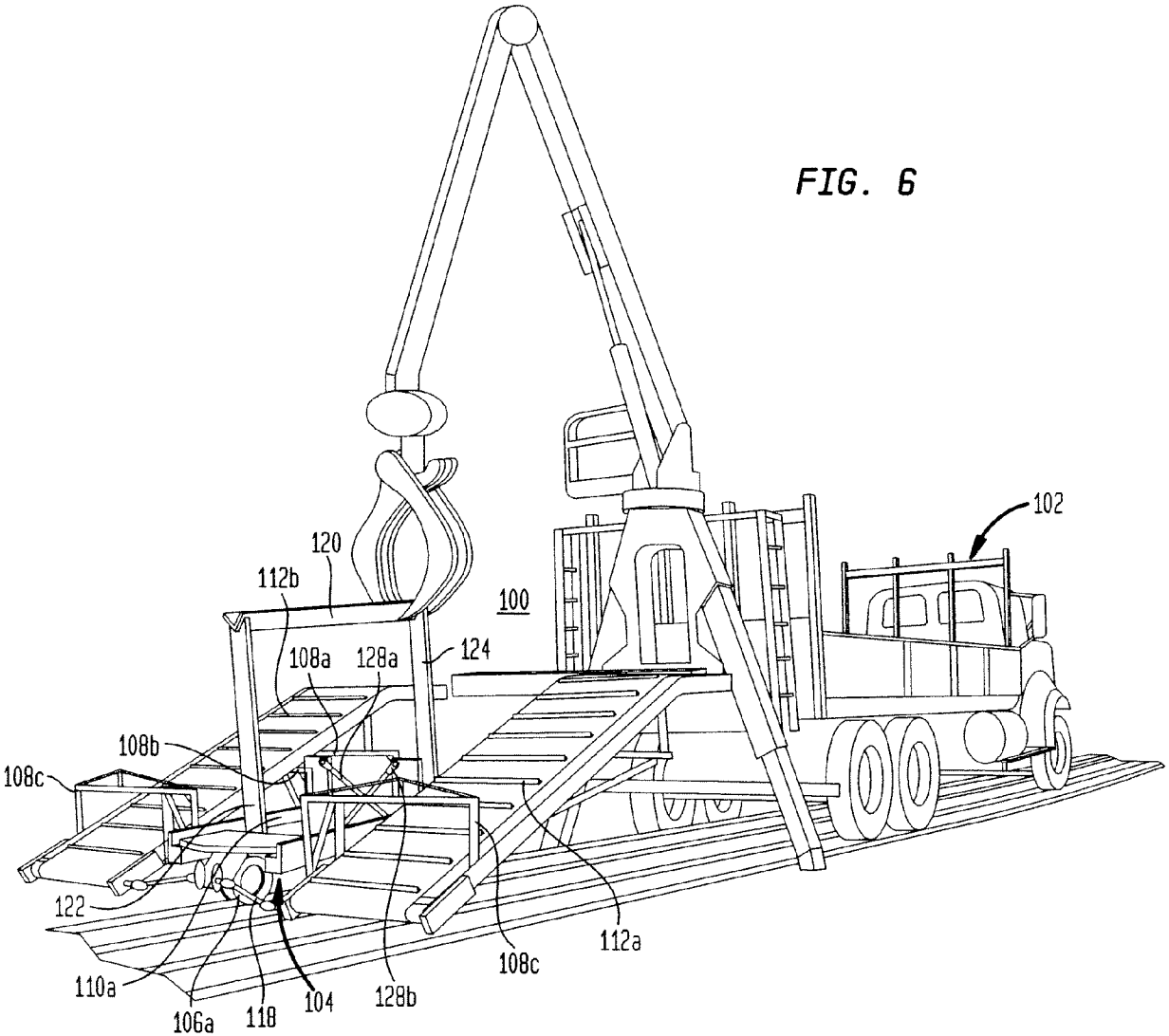
FIG. 6 shows use of the lifting member to position the apparatus being a hi-rail truck.

FIG. 6 shows an apparatus 100 of the present invention being integrated with a hi-rail truck 102. The lifting member 102 provides a means for moving the apparatus 100 and placing it in a desired position. For ease of transport, the apparatus 100 can include conveyor belt 112 raising and lowering means 128*a,b* for raising the conveyor belts 112*a,b* and rotating them inward to reduce the footprint of the apparatus 100. Once in position on the track, the belts 112*a,b* can be rotated outward and down. The preferred raising and lowering means 128*a,b* is one or more hydraulic cylinders connected to the connecting members 108*b* that extend from the conveyor belts 112*a,b* to the frame 104.

The hi-rail truck 102 can include an infeed conveyor which transports tie plates from the bed of the truck to a sliding member 114 positioned between the top end of the conveyors 112*a,b*. The tie plates can be re-directed to either of the conveyor belts 112*a,b* by sliding the tie plate across the freely-rotating ball bearings 404 embedded in the sliding members 114. The lateral movement of the tie plates is stopped when the tie plates come into contact with the guiding members 116 situated on the top surface 402 of the sliding members 114, which are positioned above the top end of the conveyor belts 112*a,b*. The tie plates are once again re-directed, this time toward the downwardly projecting conveyor belts 112*a,b*, by sliding the tie plates perpendicularly on the sliding member 114.

The tie plates are positioned on the cleated belt conveyors 112*a,b* either further inside toward the rail or further outside further away from the rail depending on the positioning of the guiding member 116 on the sliding member 114. The cleated belt on the conveyor 112 keeps the tie plates in position and aligned and delivers the tie plates to the ground adjacent the rail. A drive member 118 is connected to the rail engagement wheels 106*a,b* and extends to a drive shaft on the conveyor belts 112*a,b*. The drive member 118 times the movement of the conveyors 112*a,b* with the railroad engagement wheels 106*a,b* so the tie plates are dropped to the ground adjacent the rails at desired intervals. Alternate gearing can be used to adjust the timing of the conveyor belt 112 rotation relative to the rotation of the railroad engagement wheels 106*a,b* depending on the desired spacing between tie plates adjacent the rail.

What is claimed is:

1. An apparatus, comprising:

a generally rectangular frame having at least two rail engagement wheels positioned under the frame;

two or more connecting members projecting outwardly from each of the long sides of the frame;

two cleated belt conveyors, with one conveyor attached to each of the long sides of the frame by the connecting members, such that the conveyors are separated by a space approximately as wide as the frame;

a towing member extending away from an end of the frame;

a sliding member positioned between the cleated belt conveyors and extending above each of the cleated belt conveyors, wherein the sliding member has a top surface for receiving tie plates to be positioned on one or both of the cleated belt conveyors, and further wherein the sliding member spans the space between the conveyors;

a tie plate guiding member adjustably positioned on the top surface of the sliding member;

a drive member mechanically linking at least one of the railroad engagement wheels and the cleated belt conveyors for controlling the speed at which the cleated belt conveyors rotate; and a lifting member extending vertically from the frame, wherein the lifting member has a generally inverted U-shape and a first end of the lifting member is connected near a first short side of the frame and a second end of the lifting member is connected near a second short side of the frame.

2. The apparatus of claim 1, further comprising a cleated belt conveyor lifting and lowering means connected to the cleated belt conveyors and extending to one or more of the connecting members projecting from each of the long sides of the frame.

3. The apparatus of claim 2, wherein the cleated belt conveyor lifting and lowering means is one or more hydraulic cylinders.

4. An apparatus, comprising:

first and second conveyors positioned along opposite sides of a frame and having a width extending from an outside edge of the first conveyor to an outside edge of the second conveyor, said frame positioned centrally between the first and second conveyors; wherein the first and second conveyors are operably connected to a railroad engagement wheel positioned under the frame to time rotation of the first and second conveyors relative to the railroad engagement wheel; and lifting and lowering means connected to the first and second conveyors, wherein the conveyor belts are rotated upwardly and inwardly as the conveyor belts are lifted by the lifting and lowering means, such that the width from the outer edges of the conveyors is reduced.

5. The apparatus of claim 4, wherein the frame has a generally rectangular shape with two short sides and two long sides, and further comprises two or more connecting members projecting from each of the long sides of the frame.

6. The apparatus of claim 4, further comprising a towing member extending away from one of the short sides of the frame.

7. The apparatus of claim 4, further comprising a sliding member positioned above each of the cleated belt conveyors.

8. The apparatus of claim 7, wherein the sliding member has a top surface and comprises a plurality of ball bearings embedded in the sliding member such that the ball bearings project above the top surface of the sliding member.

9. The apparatus of claim 8, further comprising a tie plate guiding member adjustably positioned on the top surface of the sliding member.

10. The apparatus of claim 4, further comprising a railroad engagement wheel secured to and positioned under the frame.

11. The apparatus of claim 10, further comprising a drive member mechanically linking the railroad engagement wheel and the first and second conveyors for controlling the speed at which the first and second conveyors rotate.

12. The apparatus of claim 4, further comprising a lifting member extending vertically from the frame, wherein the lifting member has a generally inverted U-shape and a first end of the lifting member is connected near a first short side of the frame and a second end of the lifting member is connected near a second short side of the frame.

13. The apparatus of claim 4, wherein the first and second conveyor lifting and lowering means is one or more hydraulic cylinders.

14. The apparatus of claim 4, wherein the first and second conveyors have cleated belts.

15. An apparatus, comprising:

first and second conveyors positioned along opposite sides of a frame, said frame positioned centrally between the first and second conveyors, such that the conveyors are separated by a space approximately as wide as the frame; wherein the first and second conveyors are operably connected to a railroad engagement wheel positioned under the frame to coordinate movement of the first and second conveyors relative to the railroad engagement wheel;

a sliding member positioned between and spanning the space between the first and second cleated belt conveyors and extending above each of the cleated belt conveyors, wherein the sliding member has a top surface for receiving tie plates to be positioned on one or both of the cleated belt conveyors; and a hi-rail truck adapted for use with the first and second conveyors.

16. The apparatus of claim 15, wherein the frame has a generally rectangular shape with two short sides and two long sides, and further comprises two or more connecting members projecting from each of the long sides of the frame.

17. The apparatus of claim 15, further comprising a towing member extending away from one of the short sides of the frame.

18. A method of placing railroad tie plates alongside a rail, comprising:

alternately feeding railroad tie plates to a sliding member positioned between cleated belt conveyors such that the sliding member extends completely between the conveyors and is positioned above each of the cleated belt conveyors, wherein the sliding member has a top surface for receiving tie plates to be positioned on one or both of the cleated belt conveyors, further wherein the first and second conveyors are positioned along opposite sides of a frame positioned centrally between the first and second conveyors and the first and second conveyors are operably connected to a railroad engagement wheel positioned under the frame to coordinate movement of the first and second conveyors relative to the railroad engagement wheel; and sliding the railroad tie plates along the sliding member and onto one of the conveyor belts.

19. The method of claim 18, further comprising adjusting a guiding member positioned along a top surface of the sliding member depending on where the tie plate is to be dropped relative to the rail.

* * * * *